US012735160B2

(12) United States Patent
Bloom, Jr.

(10) Patent No.: US 12,735,160 B2
(45) Date of Patent: Sep. 15, 2026

(54) INTERIOR MOUNT STEERABLE JET DRIVE

(71) Applicant: Richard R. Bloom, Jr., Jacksonville Beach, FL (US)

(72) Inventor: Richard R. Bloom, Jr., Jacksonville Beach, FL (US)

( * ) Notice: Subject to any disclaimer, the term of this patent is extended or adjusted under 35 U.S.C. 154(b) by 246 days.

(21) Appl. No.: 18/535,195

(22) Filed: Jul. 23, 2024

(65) Prior Publication Data

US 2026/0028105 A1 Jan. 29, 2026

(51) Int. Cl.
*B63H 11/107* (2006.01)

(52) U.S. Cl.
CPC ..... *B63H 11/107* (2013.01)

(58) Field of Classification Search
CPC ..... B63H 11/107
See application file for complete search history.

(56) References Cited

U.S. PATENT DOCUMENTS 5,591,057 A * 1/1997 Dai ..... B63H 11/08 440/43

FOREIGN PATENT DOCUMENTS

KR 101761662 B1 * 7/2017 ..... B63H 11/08

* cited by examiner

*Primary Examiner* — Stephen P Avila
(74) *Attorney, Agent, or Firm* — Steven R. Scott

(57) ABSTRACT

The flush-mount multi-jet bow drive of this invention features a fixed X-shaped jet system made up of four or more fixed jet tubes mounted below a single impeller. The invention provides an isolated or divided water supply from the impeller to one or a combination of two jets in the X pattern for total 360 degree propulsion. In order to control which jets are supplied with water for propulsion, there is an angled interior jet nozzle capable of rotating 360 degrees. The jet nozzle opening is wide enough to supply 50% water pressure to two jet tubes when centered directly between the two. When the nozzle is centered with one jet tube it will be capable of supplying 100% of water pressure to a single jet tube. As the jet nozzle rotates it will supply more water pressure to the next jet tube and less from the previous.

20 Claims, 9 Drawing Sheets

INTERIOR MOUNT STEERABLE JET DRIVE

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO MICROFICHE APPENDIX

Not Applicable.

BACKGROUND OF THE INVENTION

Field of the Invention

The instant invention pertains generally to maritime vessels which may be required to, or otherwise find it advantageous to, maintain position without anchoring ("station keeping"), make fine adjustments to position, and/or move at a slower more controlled pace than that provided by the main vessel drive system. More particularly, the instant invention is directed to a steerable jet drive system that can be mounted within the hull of a vessel to provide the foregoing features, as opposed to the types of externally mounted systems (which typically take the form of "trolling" motors) currently used for this purpose.

Relevant Art

Most large yachts and ships use anchors that are retracted by a large windlass system to hold their spots overnight when away from the dock. Disadvantages include having to deploy an anchor which requires multiple crew members and a lot of strategy regarding bottom structure, depth, wind direction, and current. Many times it will take multiple attempts to successfully deploy an anchor. Many unsuccessful attempts result in stuck, lost and bent anchors costing owners more money on their vessel and sometimes an end to their trip. Anchors also do an untold amount of damage to ocean floors such as reefs and grass beds.

At the moment the only products on the market having capabilities similar to those of the invention described herein are the types of bow mounted electric trolling motors that have developed and been in use in the fishing community over a number of years. They first started with a tiller handle control and today more typically use the GPS technology referred to earlier. However the bow mounted external trolling motor described is not effective on larger vessels or any vessel in rough weather.

The only current solution for their progression to larger vessels of this type is provision of a longer shaft for the deployable electric motor in order to keep the propeller in the water and prevent cavitation. With the massive models being installed on new boats they have become an eyesore and a turn-off for buyers who do not like staring at the homely trolling motor positioned on the front of their very expensive boats. Trolling motors also have large propellers which go beyond the bottom of the boat to be effective in maneuvering. This can cause damage to the motor/prop itself and marine floors when being propelled in shallow waters.

SUMMARY AND OBJECTS OF THE INVENTION

The flush-mount multi-jet bow drive of my invention has many advantages over any current art in existence. It features a fixed X-shaped jet system made up of four or more fixed jet tubes mounted below a single impeller. The invention provides an isolated or divided water supply from a single impeller to one or a combination of two jets in the X pattern for total 360 degree propulsion. In order to control which jets are supplied with water for propulsion, there is an angled interior jet nozzle capable of rotating 360 degrees. It is located between the preferred x-shaped jet system and the impeller. The jet nozzle opening is wide enough to supply 50% water pressure to two jet tubes when centered directly between the two. When the nozzle is centered with one jet tube it will be capable of supplying 100% of water pressure to a single jet tube. As the jet nozzle rotates it will supply more water pressure to the next jet tube and less from the previous. Thus, steering can be controlled in the direction that the interior jet nozzle is facing by partially dividing the jet propulsion between jet tubes as the interior jet nozzle rotates. The jet nozzle will be turned by an alternating current electric motor which will turn a gear that is attached to the jet nozzle extruding through the bottom of the impeller housing in a series of bearings and seals.

One of the many advantages of the invention is its ability to not only be controlled directly by user, but to function automatically under remote control to the lock a vessel in a preferred location utilizing satellite GPS to obtain a GPS waypoint and correct for any deviation using appropriate amounts of thrust in the direction needed to propel the vessel back towards the GPS waypoint. This feature will essentially be an anchor setting in the controls of the invention activated by the simple click of a button. Thus, it can function in deep waters on larger vessels where an anchor would normally be required. This allows it to operate without regard to the depth or bottom structure. There is no anchor to get stuck in this anchoring method, no anchor deployment is necessary, and it is always ready to be operated. The invention can be controlled by either touch screen GPS, a wireless remote, or a hard wired remote using currently available technologies for bow mounted trolling-type motors. The invention also provides 360 degree bow control with variable power and is capable of using GPS to engage an auto pilot setting as well as following previous tracks. Manual capabilities of the invention allow directional control at any desired power setting generating 360 thrust from the forward half of the vessel. The advantages in its manual capabilities would assist in docking as bow thrusters are only capable of maneuvering port and starboard, whereas this invention can assist in any direction including port and starboard. Another huge advantage of the Flush-Mount Multi-Jet Drive invention over a noisy hydraulic/electric bow thruster is the silence in an electric jet drive.

This invention also has every advantage over new top of the line trolling motors. Being installed on the bottom of the vessel ensures it will nearly never lose power from coming out of the water. It will be mounted between two bulkheads below the floor of the boat with an accessible hatch above so that it will never be seen unless accessed. It is also totally out of the way, providing no obstructions to fisherman on the bow. And, most importantly, it is always functional with no deployment necessary.

As previously noted, trolling motors also have large propellers which go beyond the bottom of the boat to be effective in maneuvering. This can cause damage both to the propeller itself and to marine floors when being propelled in shallow waters. This invention will not sacrifice anything in terms of draft being flush mounted, and cannot cause any damage to itself or marine floors since the jets are located above the bottom of the hull and are propelling water without a propeller blade making contact with the marine floor. Another disadvantage of a trolling motor is the limited speed able to move the vessel while underway on main power and trolling motor deployed. This invention being streamline whenever turned off is capable of top speeds underway with no more precautions necessary.

BRIEF DESCRIPTION OF THE DRAWINGS

The novel features believed to be characteristic of this invention are set forth with particularity in the appended claims. The invention itself, however, both as to its organization and method of operation, together with further object and advantages thereof, may best be understood by reference to the following description taken in connection with the accompanying drawings in which:

DETAILED DESCRIPTION

Figure 1:
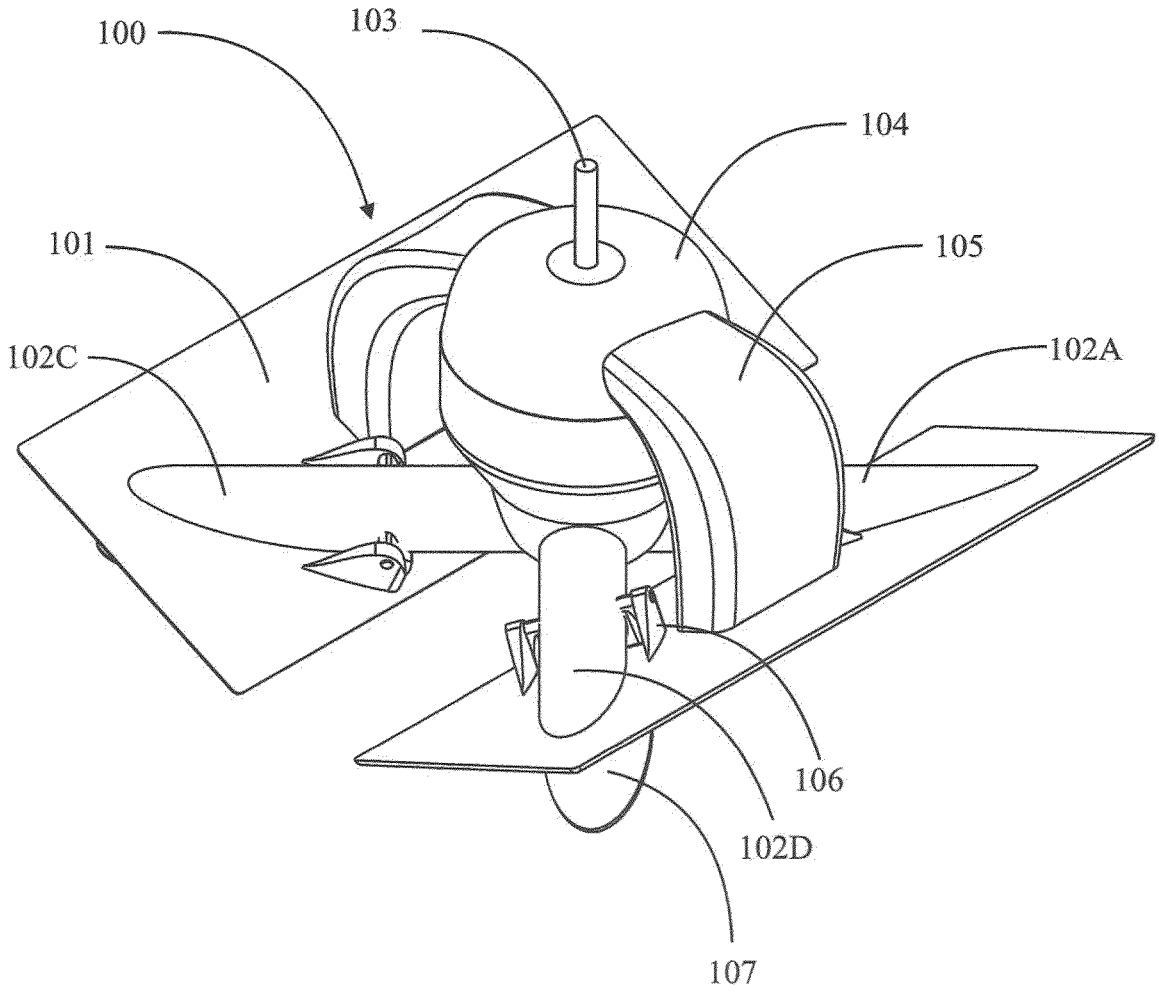
FIG. 1 provides an initial schematic perspective view (as seen from the bow facing side) of a basic version of the preferred embodiment of the invention as it would be placed in the bow of a vessel straddling the vessel's keel. (This version of the preferred embodiment allows the fundamental principles of the invention to be discussed without the necessity of covering further refinements, largely practical in nature, illustrated in the version of the preferred embodiment shown in FIGS. 7 and 8).
Figure 2:
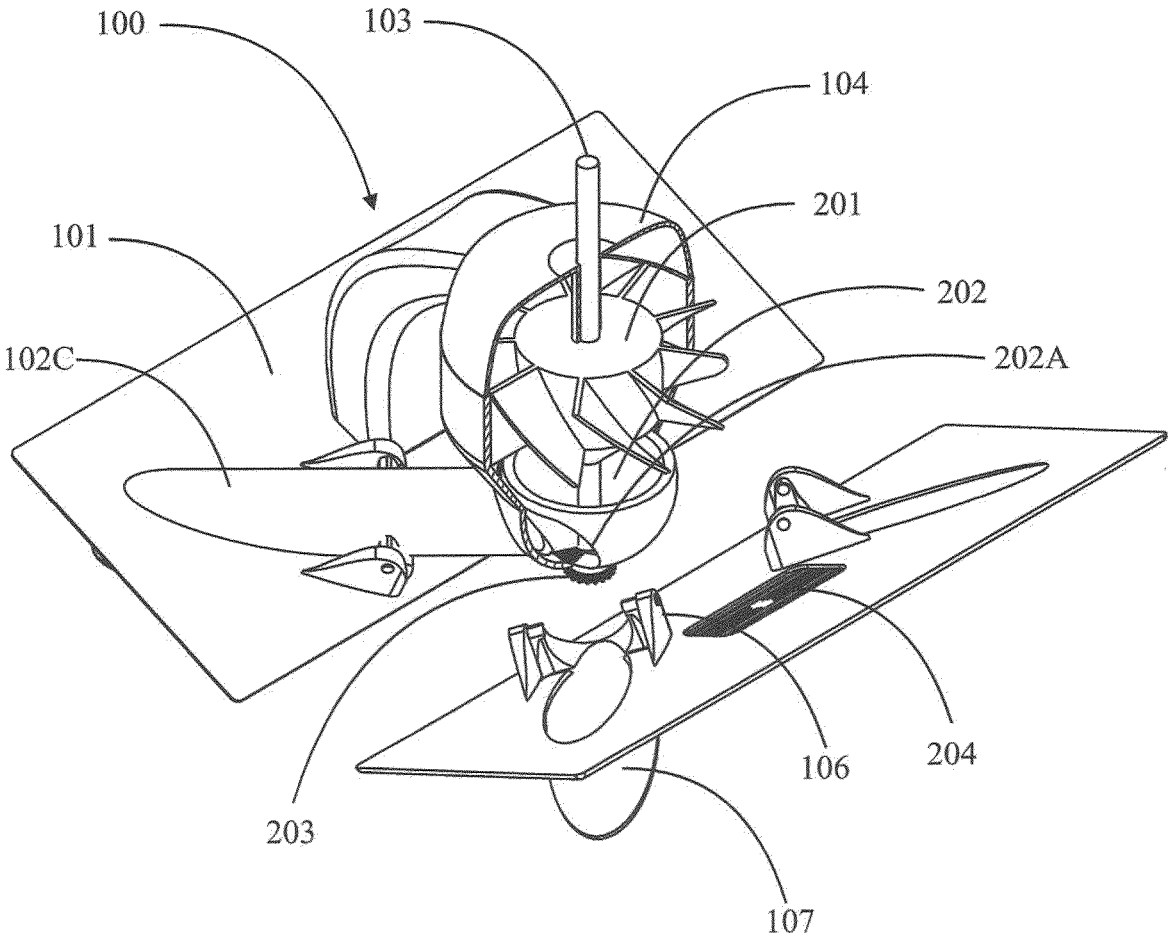
FIG. 2 provides a schematic perspective view of the embodiment illustrated in FIG. 1, wherein portions of the jet drive housing and jet tubes have been removed to expose interior features of the invention.
Figure 3:
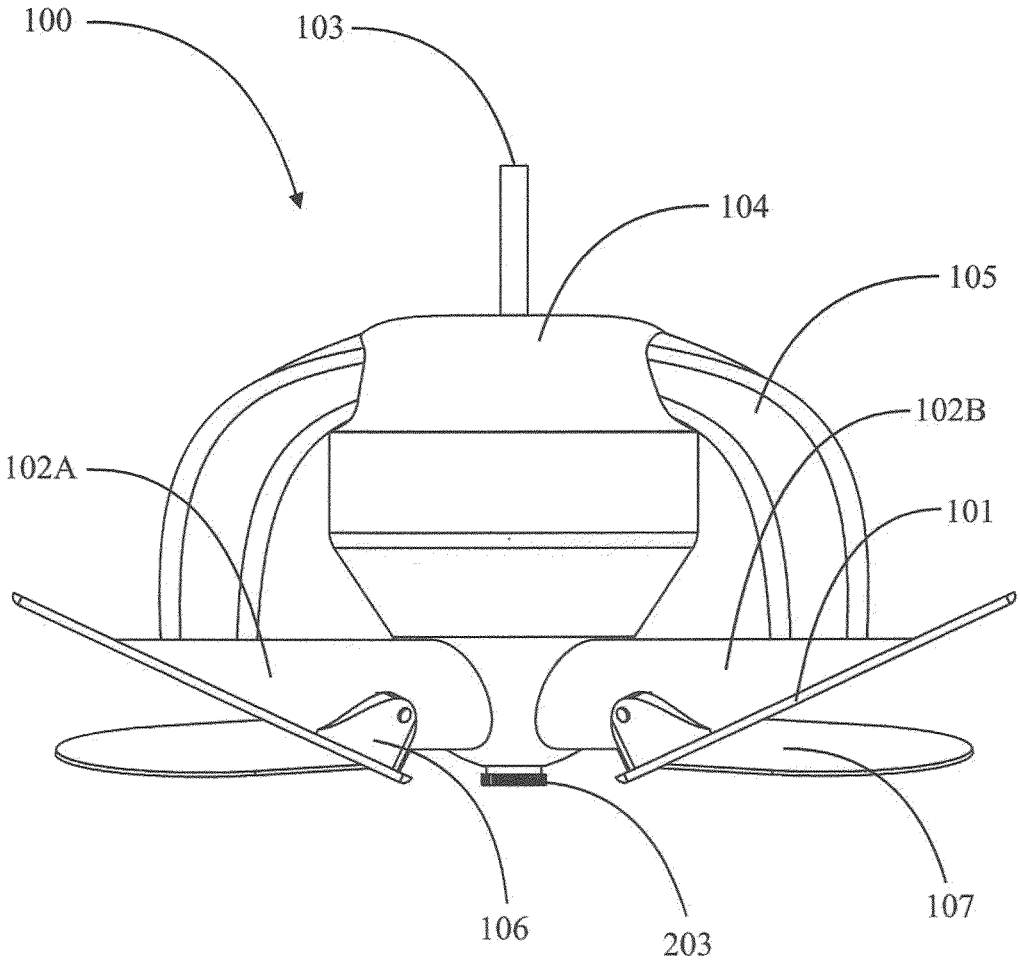
FIG. 3 provides a view of the embodiment illustrated in FIG. 1, as it would be seen straddling the vessel's keel from the bow of the vessel.
Figure 4:
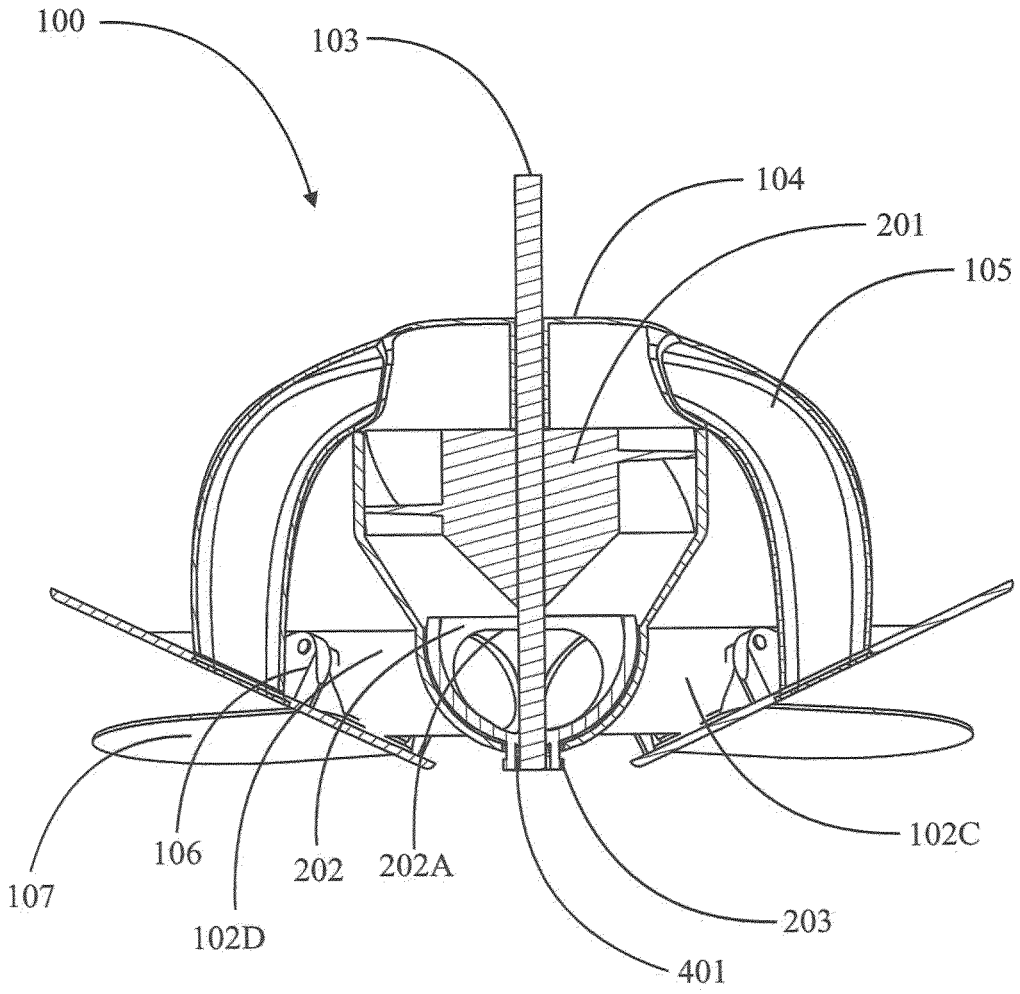
FIG. 4 provides a cross-sectional view of the embodiment illustrated in FIG. 1, as it would be seen straddling the vessel's keel from the bow of the vessel.
Figure 5:
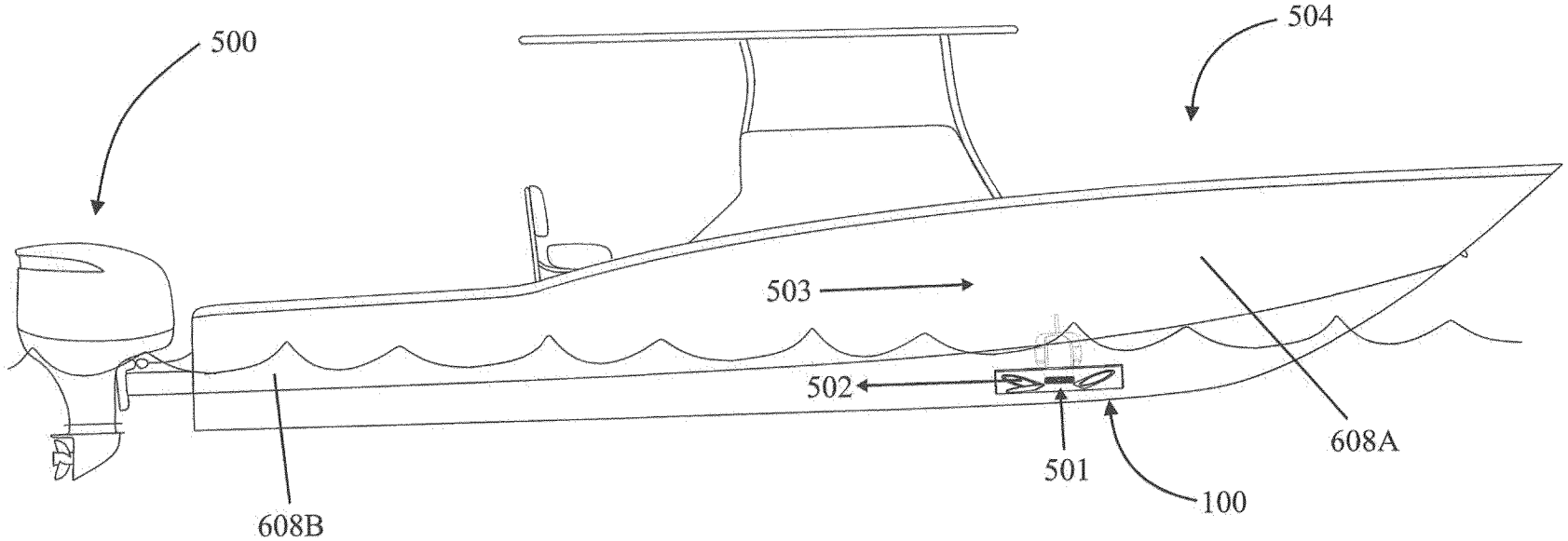
FIG. 5 provides a schematic side view of a vessel incorporating the invention.
Figure 6:
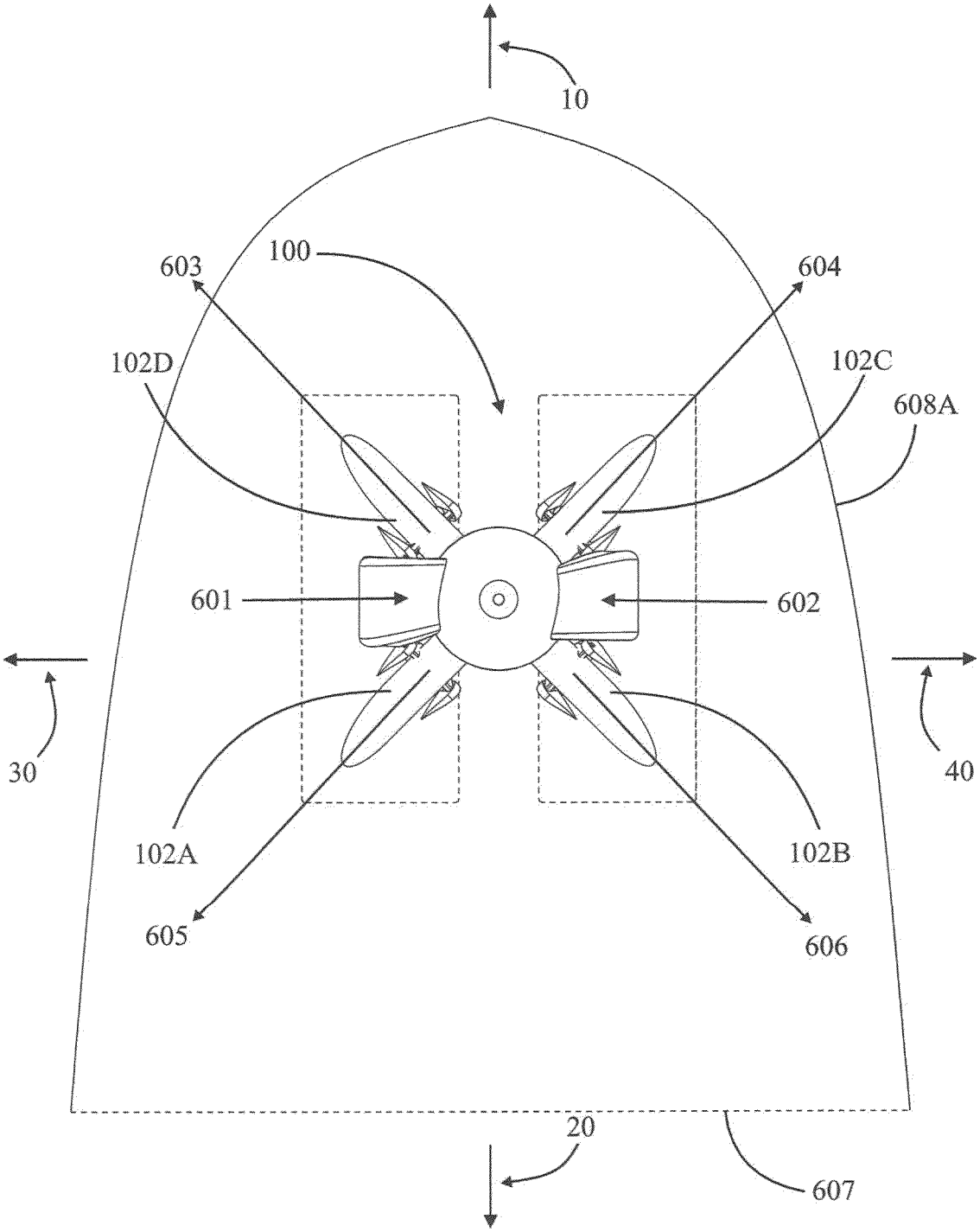
FIG. 6 provides a schematic bottom view of the invention, illustrating its placement and positioning within the hull of a vessel, straddling the vessel's keel.

Turning to FIGS. 1-6, it will be noted that the preferred embodiment of the flush-mount multi-jet drive of my invention is characterized by a fixed X-shaped jet system, made up of four or more fixed jet tubes 102, mounted below a single impeller 201. This allows the invention to provide an isolated or divided water supply from the single impeller 201 via a single jet tube (102A, 102B, 102C, or 102D) or a combination of two jet tubes out of the jet tubes 102A, 102B, 102C, 102D forming the X pattern. Thus, for example, in FIG. 1 the flow can be evenly split between the two rear facing jet tubes 102A and 102B shown to create a balanced forward thrust, can be fully directed through either jet tube 102A or 102B to create a combination forward and lateral thrust in either direction, or can be located at any point in between to create various combinations of lateral and forward thrust. A pair of thrust tubes 102A, 102B, 102C, 102D create the same options. Thus, as further described in the next paragraph, a full 360 degrees of propulsion can be provided via the system illustrated.

In order to control which jets are supplied with water for propulsion, there is an angled interior jet nozzle 202 capable of rotating 360 degrees. It is located between the X-shaped jet system formed by jet tubes 102A, 102B, 102C, 102D and the impeller 201. The jet nozzle opening 202A is wide enough to supply 50% water pressure to any two of said jet tubes 102A, 102B, 102C, 102D when centered directly between the two. When the nozzle 202 is centered on only one jet tube 102A, 102B, 102C, 102D it is supplies 100% of the water it provides to and through that single jet tube. As the jet nozzle rotates it will supply more water pressure to the next jet tube and less from the previous for total 360 degree steering control.

The jet nozzle 202 is turned by an alternating current electric motor which will turn a gear 203 that is attached to the jet nozzle 202 extruding through the bottom of the impeller housing 104 in a series of bearings and seals. To control total amount of power supplied to the jet tubes 102A, 102B, 102C, 102D, the impeller 201 can be operated at various speeds. The main drive shaft for impeller 103 can be powered by an electric dc or ac motor (not shown) depending on the vessel it will be installed on. In the preferred embodiment illustrated, the invention is installed in the forward half of the vessel to create 360 degree bow control. (See, e.g., FIGS. 5 and 6)

To create a more frictionless surface the invention is provided with two exterior mounting plates 101 for positioning port and starboard in the vessels bow. Each mounting plate 101 features two jet tube ports 102A, 102D (port side) or 102B, 102C (starboard) and one water pickup 105. To prevent the jet tubes 102A, 102B, 102C, 102D from creating drag while underway there are pressure unlocking flaps 107 that block the ports of the jet tubes 102A, 102B, 102C, 102D when not in use. These flaps 107 fit perfectly flush into small shaped recesses in the mounting plates 101. Flaps 107 are hinged below the jet tubes 102A, 102B, 102C, 102D and pivot on a spring hinge. Thus, when flaps 107 are not open, the hinges act like springs to retract flaps 107 into their respective recesses, blocking its respective jet tube 102A, 102B, 102C, 102D and creating a flush surface on the hull of the vessel. Flaps 107 lock while not in use, and are opened when water pressure is forced into various jet tubes 102A, 102B, 102C, 102D from the impeller 201. When water is forced into particular jet tubes 102A, 102B, 102C, 102D, the pressure will unlock the flaps 107 provided for those jet tubes 102A, 102B, 102C, 102D allowing the water pressure to push down said flaps 107 against the power of the spring hinge.

The water pickups 105 for the impeller 201 are preferably installed between the two jet tubes 102A and 102D or 102B and 102C, of their respective plates 101 as illustrated in the Drawing Figures, but other locations are also possible. The water pickups 105 are protected by a water pick-up grate 204 that can prevent debris from getting into the impeller. In the event one or more grates clog, the impeller 201 will automatically reverse and spin in reverse to flush any such debris from the grate 204.

Figure 7:
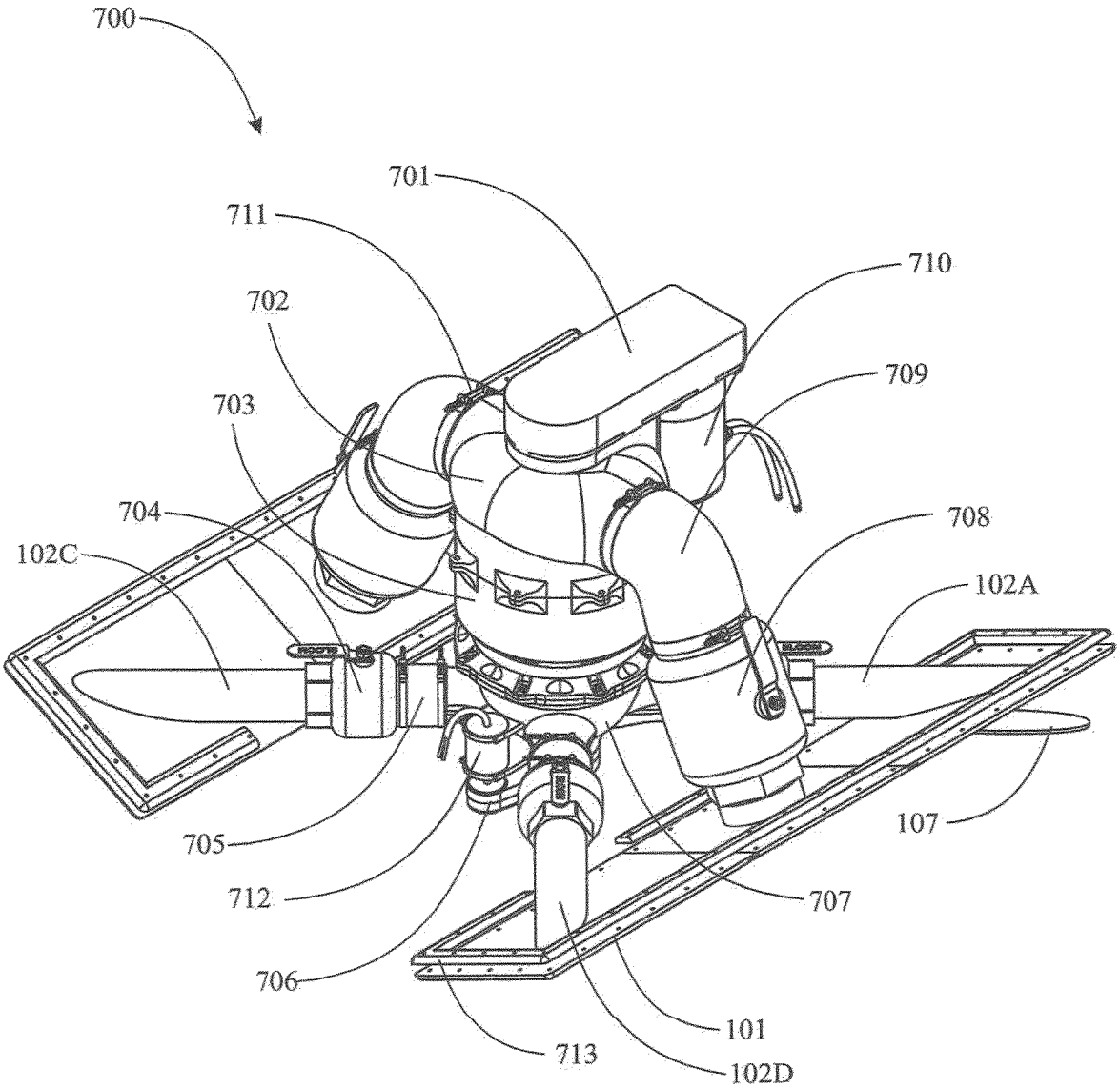
FIG. 7 provides a perspective view of the preferred embodiment of the invention illustrated in FIG. 1, as it would be placed in the bow of a vessel straddling the vessel's keel. (This version of the preferred embodiment includes further refinements, largely practical in nature, not shown in FIGS. 1 through 6).
Figure 8:
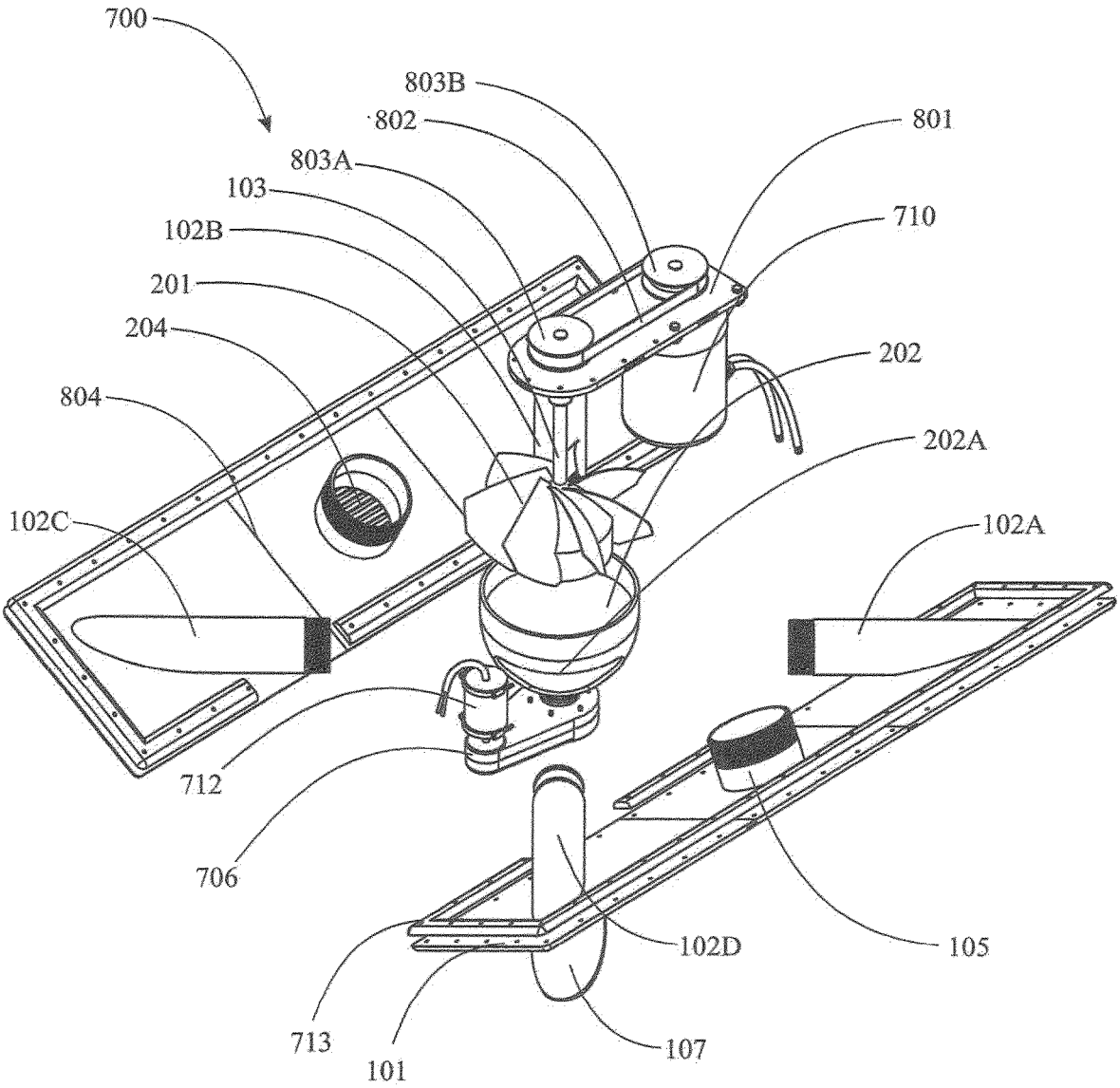
FIG. 8 provides a perspective view of the embodiment illustrated in FIG. 7, wherein portions of the jet drive housing and jet tubes have been removed to expose interior features of the invention.
Figure 9:
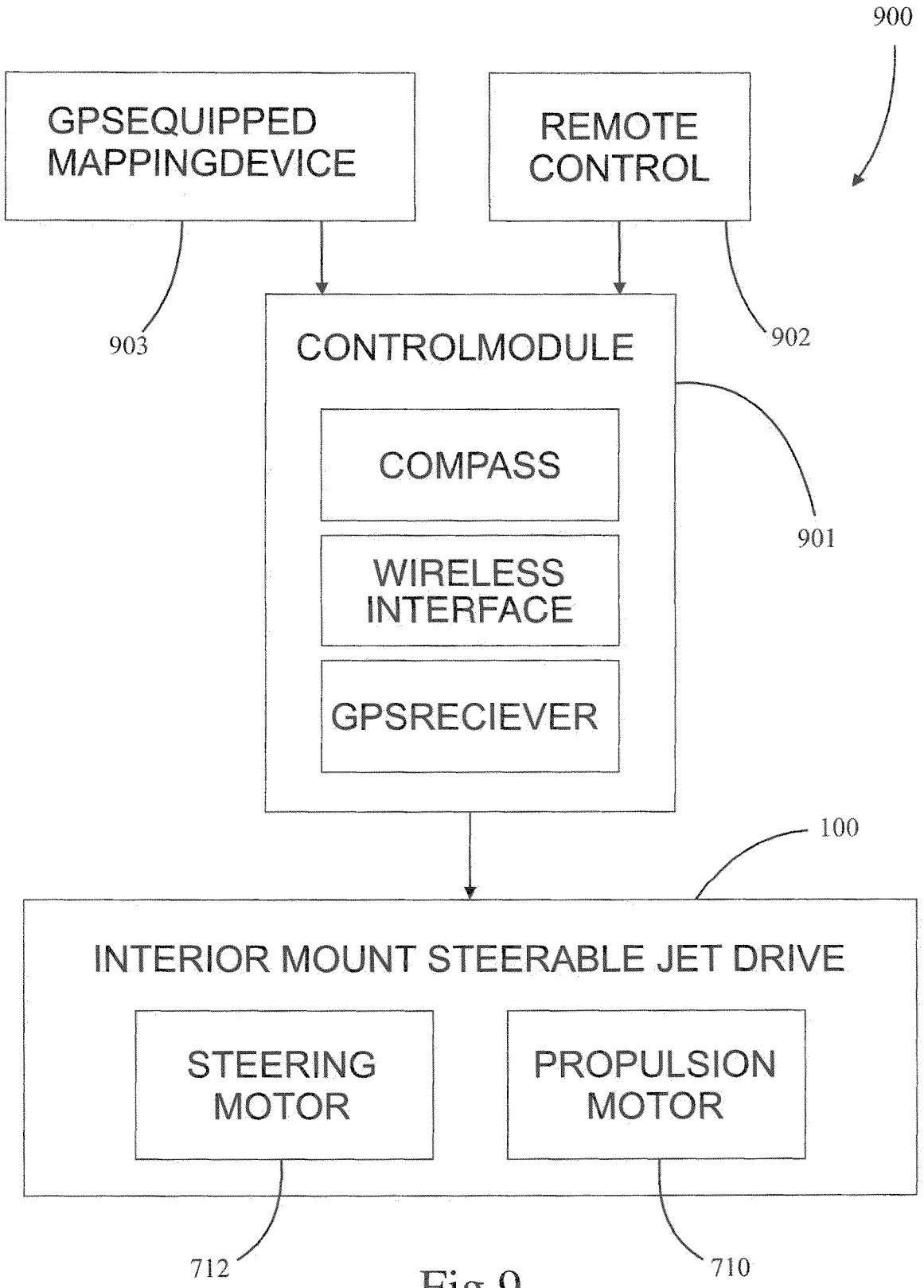
FIG. 9 provides a schematic diagram illustrating key systems of the invention.

Turning next to FIGS. 7 and 8, it will be noted that these drawing figures do not depart substantially from the system and functional components illustrated in the previous drawing figures, but expand what has previously been shown and discussed via the illustration and inclusion of further refinements which are largely practical in nature. Thus, as previously noted, the flush-mount multi-jet drive 700 illustrated in these figures is characterized by the same fixed X-shaped jet system (characterized by jet tubes 102A, 102B, 102C and 102D), mounted below a single impeller (denoted 102 in previous drawing figures, but now shown to be comprised of cavitation free dual pick-up water pump housing 702, impeller housing 703, and interior rotating jet nozzle housing 707). As previously explained, this can be used to provide an isolated or divided water supply via a single jet tube (102A, 102B, 102C, or 102D) or a combination of two jet tubes out of the jet tubes 102A, 102B, 102C, 102D forming the X pattern.

However, as further illustrated in FIGS. 7 and 8, the aforesaid jets 102A, 102B, 102C, 102D can advantageously be provided with internally streamlined ball-valves 704 connected to jet nozzle housing 707 via internally streamlined hydraulic connecting boots 705. Likewise, the water pick-ups of flush-mount multi-jet drive 700 are comprised of large pick-up ball valves 708 and hydraulic boots 709 in FIGS. 7 and 8, with said boots 709, like other boots shown, being secured in place via clamps 711. This advantageous arrangement allows the impeller portion 702, 703, 707 and related/included parts to be isolated or cut-off from the water surrounding the vessel and/or removed for servicing, repair or replacement.

Additional note should be taken of the following:

(1) Further components, some of which are alluded to in discussions of FIGS. 1-6, but not shown, and others that are included only in FIGS. 7 and 8, are described in the Parts List, below, with their functions being previously described and/or obvious from the Parts List, drawing figures, or prior discussions.

(2) For smaller vessels (roughly 12'-40') a 12v, 24v, 36v, or 48v motor and battery setup in series can advantageously be used to supply power to the invention. Smaller vessels will use less batteries. When multiple batteries are used for 24v and up applications, the multiple 12v batteries can be wired in series to create the added amperage required. The batteries can be charged on smaller vessels/applications using an onboard battery charger which charges the batteries while not in use, and can receive additional charging during use via outboard motor alternators via an automatic charging relay (ACR).

(3) On large vessel applications (roughly 35'-125') the main power supply can be 110v/120v being supplied power from the vessel's generator. The invention will still be capable of using power supplied from a 30 or 50 amp shore power cord as well for testing applications or dock use.

(4) The control system for the invention will preferably include a "return to home" function when turned off making the opening of the nozzle 202A face the two stern jet tubes 102A and 102B in case water forces its way through the pick-ups 105 into the system while underway and thereby possibly creating water pressure, it will only force open the two stern flaps 102A and 102B (which will be ultimately forced shut by water flow below the hull) instead of the front flaps 102C and 102D, which would cause damage to the front flaps and possibly to the rest of the system.

PARTS LIST

10 Arrow indicating forward direction/axis
20 Arrow indicating aft direction/axis
30 Arrow indicating port direction/axis
40 Arrow indicating starboard direction/axis
100 Basic schematic version of preferred embodiment of the flush mounted multi-jet drive of the invention
101 Exterior mounting plates
102A Aft/port-side jet tube
102B Aft/starboard-side jet tube
102C Forward/starboard-side jet tube
102D Forward/port-side jet tube
103 Main jet drive shaft
104 Jet drive housing
105 Water pick-ups
106 Spring loaded/self-unlocking hinge for flap covering jet tube
107 Flap covering jet tube
201 Impeller
202 Steerable ball jet nozzle
202A Jet nozzle openings
203 Gear for controlling ball jet nozzle
204 Water pick-up grate
401 Two layers of ball bearings separating ball jet nozzle from jet drive housing and main jet drive shaft from ball jet nozzle
500 Main propulsion motor
501 Direction of water stream pulled into flush mount multi-jet driver's
502 Direction of water streams when propelling vessel forward
503 Direction of vessel when propelled forward by jet stream illustrated in 502
504 Vessel
601 Direction of water when pulled into port side water pick-up
602 Direction of water when pulled into starboard side water pick-up
603 Direction of water expelled when propelling vessel in a stern-starboard direction
604 Direction of water expelled when propelling vessel in a stern-port direction
605 Direction of water expelled when propelling vessel in a forward-star board direction
606 Direction of water expelled when propelling vessel in a forward-port direction
607 Broken line indicating mid-ship
608A Forward half of vessel
608B Aft half of vessel
700 More detailed version of the preferred embodiment of the flush mounted multi-jet drive of the invention
701 Belt housing cover
702 Cavitation free dual pick-up water pump housing
703 Impeller housing
704 Internally streamline ball-valve mounted inline of jet-tubes
705 Internally streamline hydraulic connecting boots
706 Gear box for turning angled interior jet nozzle 360 degrees
707 Interior rotating jet nozzle housing
708 Large water pick-up ball valve
709 Hydraulic boot connecting 708 to 702

710 Main electric motor that supplies power to impeller
711 Boot clamp
712 Electric motor that controls steering
713 Inside hull mounting bracket
801 Belt and pulley mounting plate
802 Belt
803 Pulley
804 Line depicting separation in exterior plate for retro-fit applications
805 Angled rotating jet nozzle opening capable of supplying flow to two or less jet tubes
900 Schematic diagram illustrating key systems of, or related to, the invention.
901 Control Module (Prior Art)
902 Remote control (Prior Art)
903 GPS equipped mapping device (Prior Art)

In view of the foregoing, it should be clear that numerous changes and variations can be made without exceeding the scope of the inventive concept outlined. Accordingly, it is to be understood that the embodiment(s) of the invention herein described is/are merely illustrative of the application of the principles of the invention. Reference herein to details of the illustrated embodiment(s) is not intended to limit the scope of the claims, which recite those features regarded as essential to the invention.

The invention claimed is:

1. A multi-jet drive for marine vessels, comprising:

an impeller mounted within the hull of the vessel, which impeller can be activated to draw in water from ambient water surrounding the hull of the vessel and expel said water in a forceful stream;

a controllable rotatable jet nozzle receiving the forceful stream from the impeller and directing it selectively through at least one of a plurality of fixed jet tubes mounted within the hull of the vessel, which jet tubes are in fluid communication with said ambient water surrounding the hull of the vessel; and a control mechanism for activating said impeller and controlling said rotatable jet nozzle so as to direct said stream selectively through at least one of said plurality of fixed jet tubes; and wherein at least one of:

said impeller is a variable speed impeller, wherein said speed is controlled by said control mechanism, said apparatus further comprises two exterior mounting plates, one positioned on the port side of the vessel and the other positioned on the starboard side of the vessel, wherein each of said mounting plates has two jet tube ports, and each jet tube is provided, at a jet tube port thereof, with pressure unlocking flaps that are spring biased to the closed position so as to block the port when it is not in use but will be opened by the pressure of water flowing through the port when in use, thereby serve to diminish drag while the vessel is underway.

2. The apparatus of claim 1, wherein said vessel has a bow, defining a forward direction, a stern, defining an aft direction, a starboard side, defining a starboard direction, and a port side, defining a port direction, wherein at least one of:

at least one of jet tubes expels water in an at least partially forward direction, at least one of said jet tubes expels water in an at least partially aft direction, at least one of said jet tubes expels water in an at least partially starboard direction, and at least one of said jet tubes expels water in an at least partially port direction, at least two of said jet tubes expel water in an at least partially forward direction, at least two of said jet tubes expel water in an at least partially aft direction, at least two of said jet tubes expel water in an at least partially starboard direction, and at least two of said jet tubes expel water in an at least partially port direction, and said vessel has a bow portion and a stern portion and said multi-jet drive is positioned in said bow portion.

3. The apparatus of claim 1, wherein at least one of:

said plurality of fixed jet tubes is comprised of four jet tubes set in an X pattern wherein each said jet tube is separated by ninety degrees from adjacent jet tubes, with two of said jet tubes expelling water on the port side and two expelling water on the starboard side, said plurality of fixed jet tubes is comprised of four jet tubes set in an X pattern wherein each said jet tube is separated by ninety degrees from adjacent jet tubes and forty-five degrees from an adjacent forward or aft axis, such that two of said jet tubes expel water on the port side, and two expel water on the starboard side, and said vessel has a bow portion and a stern portion and said multi-jet drive is positioned in said bow portion.

4. The apparatus of claim 1, wherein said control mechanism is at least one of:

directly actuated and controlled by a user, and actuated and controlled in response to GPS signals.

5. The apparatus of claim 2, wherein said control mechanism is at least one of:

directly actuated and controlled by a user, and actuated and controlled in response to GPS signals.

6. The apparatus of claim 3, wherein said control mechanism is at least one of:

directly actuated and controlled by a user, and actuated and controlled in response to GPS signals.

7. The apparatus of claim 1, wherein said jet nozzle has an opening proportioned to supply 50% of said stream to any two adjacent jet tubes when centered equidistant between the two, to supply 100% of said stream through a single jet tube when centered thereon, varying the amount between 50% and 100% as it is moved between adjacent jet tubes, with the jet nozzle being rotatable by the control mechanism through a full 360 degrees as necessary for station keeping and other maneuvers.

8. The apparatus of claim 2, wherein said jet nozzle has an opening proportioned to supply 50% of said stream to any two adjacent jet tubes when centered equidistant between the two, to supply 100% of said stream through a single jet tube when centered thereon, varying the amount between 50% and 100% as it is moved between adjacent jet tubes, with the jet nozzle being rotatable by the control mechanism through a full 360 degrees as necessary for station keeping and other maneuvers.

9. The apparatus of claim 3, wherein said jet nozzle has an opening proportioned to supply 50% of said stream to any two adjacent jet tubes when centered equidistant between the two, to supply 100% of said stream through a single jet tube when centered thereon, varying the amount between 50% and 100% as it is moved between adjacent jet tubes, with the jet nozzle being rotatable by the control mechanism through a full 360 degrees as necessary for station keeping and other maneuvers.

10. The apparatus of claim 4, wherein said jet nozzle has an opening proportioned to supply 50% of said stream to any two adjacent jet tubes when centered equidistant between the two, to supply 100% of said stream through a single jet tube when centered thereon, varying the amount between 50% and 100% as it is moved between adjacent jet tubes, with the jet nozzle being rotatable by the control mechanism through a full 360 degrees as necessary for station keeping and other maneuvers.

11. The apparatus of claim 5, wherein said jet nozzle has an opening proportioned to supply 50% of said stream to any two adjacent jet tubes when centered equidistant between the two, to supply 100% of said stream through a single jet tube when centered thereon, varying the amount between 50% and 100% as it is moved between adjacent jet tubes, with the jet nozzle being rotatable by the control mechanism through a full 360 degrees as necessary for station keeping and other maneuvers.

12. The apparatus of claim 6, wherein said jet nozzle has an opening proportioned to supply 50% of said stream to any two adjacent jet tubes when centered equidistant between the two, to supply 100% of said stream through a single jet tube when centered thereon, varying the amount between 50% and 100% as it is moved between adjacent jet tubes, with the jet nozzle being rotatable by the control mechanism through a full 360 degrees as necessary for station keeping and other maneuvers.

13. The apparatus of claim 1, further comprising two water pick-ups for the impeller, with one positioned between adjacent jet tubes on the port side and the other positioned between adjacent jet tubes on the starboard side, said water pick-ups being provide with a grate to prevent debris from reaching the impeller.

14. The apparatus of claim 2, further comprising two water pick-ups for the impeller, with one positioned between adjacent jet tubes on the port side and the other positioned between adjacent jet tubes on the starboard side, said water pick-ups being provide with a grate to prevent debris from reaching the impeller.

15. The apparatus of claim 3, further comprising two water pick-ups for the impeller, with one positioned between adjacent jet tubes on the port side and the other positioned between adjacent jet tubes on the starboard side, said water pick-ups being provide with a grate to prevent debris from reaching the impeller.

16. The apparatus of claim 4, further comprising two water pick-ups for the impeller, with one positioned between adjacent jet tubes on the port side and the other positioned between adjacent jet tubes on the starboard side, said water pick-ups being provide with a grate to prevent debris from reaching the impeller.

17. The apparatus of claim 5, further comprising two water pick-ups for the impeller, with one positioned between adjacent jet tubes on the port side and the other positioned between adjacent jet tubes on the starboard side, said water pick-ups being provide with a grate to prevent debris from reaching the impeller.

18. The apparatus of claim 6, further comprising two water pick-ups for the impeller, with one positioned between adjacent jet tubes on the port side and the other positioned between adjacent jet tubes on the starboard side, said water pick-ups being provide with a grate to prevent debris from reaching the impeller.

19. The apparatus of claim 7, further comprising two water pick-ups for the impeller, with one positioned between adjacent jet tubes on the port side and the other positioned between adjacent jet tubes on the starboard side, said water pick-ups being provide with a grate to prevent debris from reaching the impeller.

20. The apparatus of claim 8, further comprising two water pick-ups for the impeller, with one positioned between adjacent jet tubes on the port side and the other positioned between adjacent jet tubes on the starboard side, said water pick-ups being provide with a grate to prevent debris from reaching the impeller.

* * * * *